US007764021B2

(12) United States Patent
Liu et al.

(10) Patent No.: US 7,764,021 B2
(45) Date of Patent: Jul. 27, 2010

(54) INTEGRATED CIRCUIT CAPABLE OF ENHANCED LAMP IGNITION

(75) Inventors: Da Liu, San Jose, CA (US); Sheng Tai Lee, Taipei (TW); Ching Chuan Kuo, Taipei (TW)

(73) Assignee: O2Micro International Limited, Georgetown, Grand Cayman (KY)

( * ) Notice: Subject to any disclaimer, the term of this patent is extended or adjusted under 35 U.S.C. 154(b) by 107 days.

(21) Appl. No.: 11/105,860

(22) Filed: Apr. 14, 2005

(65) Prior Publication Data

US 2006/0232222 A1 Oct. 19, 2006

(51) Int. Cl.
*H05B 37/02* (2006.01)

(52) U.S. Cl. ..... 315/224; 315/291; 315/307

(58) Field of Classification Search ..... 315/224, 315/209 R, 225, 291, 312, 300, 302, 307, 315/308, 226
See application file for complete search history.

(56) References Cited

U.S. PATENT DOCUMENTS 6,979,959 B2 * 12/2005 Henry ..... 315/291
7,084,586 B2 * 8/2006 Ishihara et al. ..... 315/308
7,151,346 B2 * 12/2006 Sanchez ..... 315/308
2003/0206426 A1 * 11/2003 Lin et al. ..... 363/132
2003/0208426 A1 11/2003 Rosenberg
2004/0113567 A1 * 6/2004 Yamauchi et al. ..... 315/291
2004/0113569 A1 6/2004 Henry

OTHER PUBLICATIONS

English translation of Preliminary Rejection of related ROC (Taiwan) Patent Application dated May 23, 2007, 3 pages.
English language translation of Chinese Office Action dated Mar. 6, 2009 issued in Chinese Patent Application No. 200610072430.X.

* cited by examiner

*Primary Examiner*—Douglas W Owens
*Assistant Examiner*—Dieu Hien T Duong
(74) *Attorney, Agent, or Firm*—Grossman, Tucker, Perreault & Pfleger, PLLC

(57) ABSTRACT

A method according to one embodiment may include supplying ignition power and steady state power to at least one lamp. The method of this embodiment may also include receiving, during an ignition period of said lamp, a feedback signal indicative of power supplied to said lamp; comparing said feedback signal to a signal that is approximately equal to a signal indicative of steady state power; and maintaining a supply of ignition power to said lamp while said feedback signal remains below said signal indicative of said steady state power. Of course, many alternatives, variations, and modifications are possible without departing from this embodiment.

10 Claims, 4 Drawing Sheets

INTEGRATED CIRCUIT CAPABLE OF ENHANCED LAMP IGNITION

FIELD

The present disclosure relates to an integrated circuit capable of enhanced lamp ignition.

BACKGROUND

In one conventional power supply, a lamp controller may be provided to supply power to a cold cathode fluorescent lamp (CCFL). The lamp controller may include a feedback circuit to detect lamp current or voltage, and the lamp controller may adjust power to the lamp based on the feedback information. During an ignition period of a typical lamp, the controller supplies high voltage to the lamp until the lamp is ignited, and thereafter, during a normal operating mode, the supply voltage is reduced. The conventional controller identifies whether the lamps are turned on by detecting if lamp current reaches a threshold. If the conventional controller detects the existence of the lamp current in striking period, it causes inverter controller to end the striking (ignition) mode and switch to a normal, steady state operation mode. During this period, there is insufficient of current flowing through the lamp. Thus, the feedback of the current signal may not reach a commended signal level and lamp ignition failure may happen.

SUMMARY

One embodiment described herein provides an inverter controller capable of supplying ignition power and steady state power to at least one lamp. The inverter controller is also capable of receiving, during an ignition period of the lamp, a feedback signal indicative of power supplied to the lamp and comparing, via a comparator, the feedback signal to a signal that is approximately equal to a signal indicative of steady state power and maintaining a supply of ignition power to said lamp while said feedback signal remains below said signal indicative of said steady state power.

Another embodiment described herein provides an inverter controller capable of supplying ignition power and steady state power to at least one lamp. The inverter controller includes open lamp protection circuitry capable of generating a delay signal, the open lamp protection circuitry is capable of extending the delay time of the delay signal until the delay signal equals or exceeds a shutdown threshold signal, or until the controller is delivering steady state power to the lamp.

At least one system embodiment described herein provides a liquid crystal display (LCD) panel comprising at least one lamp and an inverter controller capable of supplying ignition power and steady state power to said at least one lamp. The inverter controller is also capable of receiving, during an ignition period of the lamp, a feedback signal indicative of power supplied to the lamp and comparing, via a comparator, the feedback signal to a signal that is approximately equal to a signal indicative of steady state power and maintaining a supply of ignition power to the lamp while said feedback signal remains below said signal indicative of the steady state power.

At least one method described herein includes supplying ignition power and steady state power to at least one lamp; receiving, during an ignition period of the lamp, a feedback signal indicative of power supplied to the lamp; comparing the feedback signal to a signal that is approximately equal to a signal indicative of steady state power; and maintaining a supply of ignition power to the lamp while the feedback signal remains below the signal indicative of the steady state power.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Although the following Detailed Description will proceed with reference being made to illustrative embodiments, many alternatives, modifications, and variations thereof will be apparent to those skilled in the art. Accordingly, it is intended that the claimed subject matter be viewed broadly, and be defined only as set forth in the accompanying claims.

DETAILED DESCRIPTION

Figure 1:
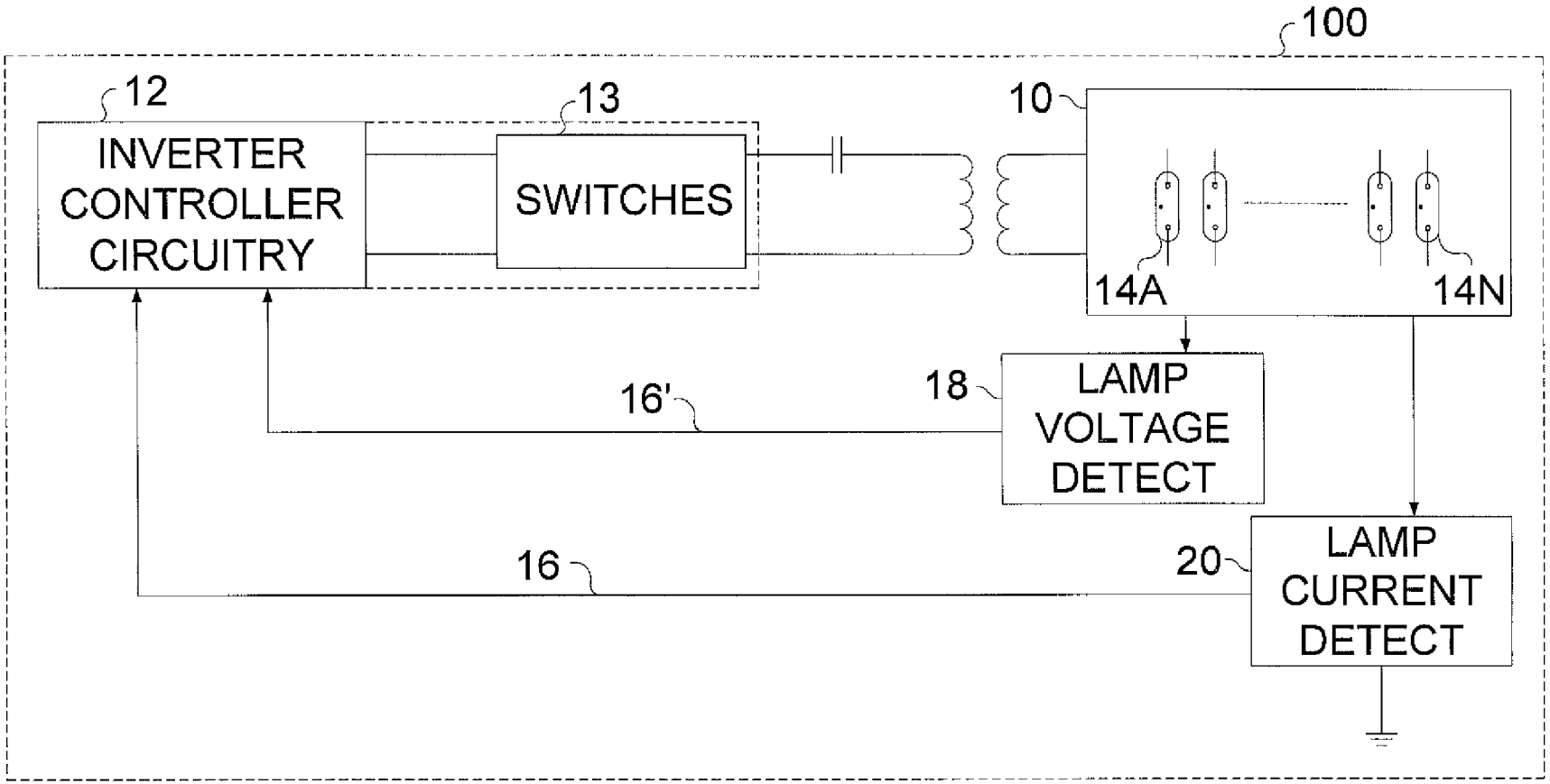
FIG. 1 is a diagram illustrating a system embodiment.

FIG. 1 illustrates a system embodiment 100 of the claimed subject matter. The system 100 may generally include a liquid crystal display (LCD) panel 10 and circuitry to supply power to the panel 10. The circuitry to supply power to the panel 10 may include inverter controller circuitry 12 which may be capable of controlling one or more switches 13 to supply power to one or more cold cathode fluorescent lamps (CCFLs), for example, CCFL 14A . . . 14B . . . , and/or 14N comprised in panel 10. As used in any embodiment herein, "circuitry" may comprise, for example, singly or in any combination, hardwired circuitry, programmable circuitry, state machine circuitry, and/or firmware that stores instructions executed by programmable circuitry. Inverter controller circuitry 12 and/or other circuitry may individually or collectively comprise one or more integrated circuits. As used in any embodiment herein, an "integrated circuit" means a semiconductor device and/or microelectronic device, such as, for example, a semiconductor integrated circuit chip. System 100 may also comprise memory (not shown) which may comprise one or more of the following types of memory: semiconductor firmware memory, programmable memory, non-volatile memory, read only memory, electrically programmable memory, random access memory, flash memory, magnetic disk memory, and/or optical disk memory. Either additionally or alternatively, memory may comprise other and/or later-developed types of computer-readable memory. Machine-readable firmware program instructions may be stored in memory. As described below, these instructions may be accessed and executed by inverter controller circuitry 12, and these instructions may result in inverter controller circuitry 12 performing the operations described herein as being performed by inverter controller circuitry 12 and/or other circuitry comprised in system 100.

Inverter controller circuitry 12 may be capable of generating an AC signal from a DC signal, and such circuitry may include, for example, a full bridge, half bridge, push-pull and/or Class D type inverter circuitry. Inverter controller circuitry 12 may control a plurality of switches 13, which may be arranged in a full bridge, half bridge, push-pull and/or Class D type topology. System 100 may also include voltage feedback circuitry 16' which may be capable of generating a feedback signal indicative of, or proportional to, the voltage of one or more CCFLs in panel 10, via lamp voltage detect circuitry 18. System 100 may also include current feedback circuitry 16 which may be capable of generating a feedback signal indicative of, or proportional to, the current of one or more CCFLs in panel 10, via lamp current detect circuitry 18. Inverter controller circuitry 12 may be capable of adjusting power supplied to one or more CCFLs based on, at least in part, voltage and/or current feedback information, as may be generated by feedback circuitry 16 and/or 16'.

Figure 2:
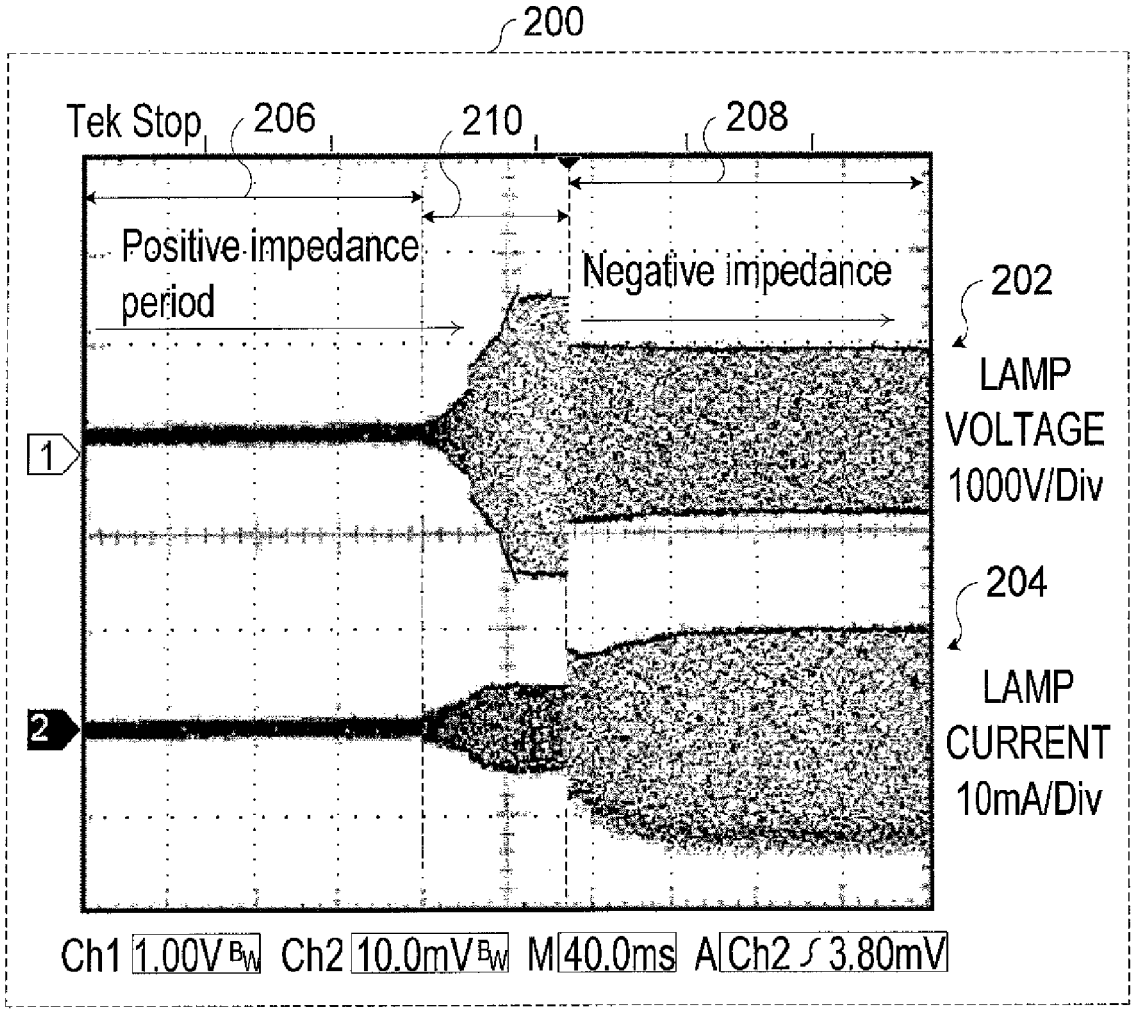
FIG. 2 is a graph of lamp characteristics during an ignition period and a steady state period.

Inverter controller 12 may be capable of operating in a first operating mode and a second operating mode. The first operating mode may include an ignition mode which may include igniting one or more CCFLs. The second operating mode may include a steady state mode which may include controllably supplying power to one or more CCFLs after ignition. FIG. 2 is a graph 200 of lamp characteristics during an ignition period and a steady state period. In particular, FIG. 2 depicts lamp voltage 202 and lamp current 204 during an ignition period 206 and a steady period 208. While a normal lamp may exhibit a sharp transition of lamp voltage 204 and lamp current 204 between the striking period 206 and the steady state period 208, due to lamp impurities, the lamp may exhibit an increase in lamp voltage 202 before ignition period 208, as is depicted in transition period 210. Similarly, the lamp may exhibit an increase in lamp current 204 before ignition period 208, as depicted in transition period 210. Also, as depicted in FIG. 2, before a CCFL is ignited (i.e., during an ignition period 206), the CCFL may present a positive impedance to the inverter controller 12. Once the CCFL ignites (i.e., during a steady state period 208), the CCFL may present a negative impedance to the inverter controller 12.

Figure 3:
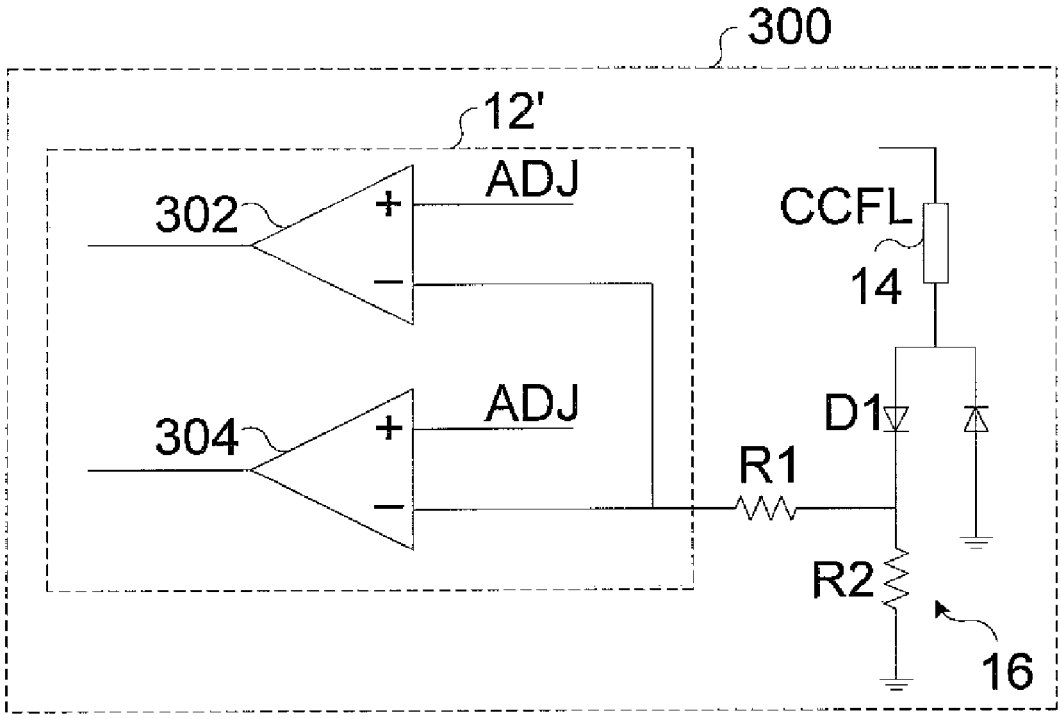
FIG. 3 is a diagram illustrating one exemplary inverter controller.

FIG. 3 depicts exemplary inverter controller circuitry 12' according to one embodiment. As stated, inverter controller circuitry 12' may be operable to control voltage and/or current delivered to the CCFL. In this embodiment, and as will be described in greater detail herein, inverter controller circuitry 12' may further be operable to distinguish the ignition mode and the steady state mode of inverter controller 12'. In this embodiment, steady state lamp voltage and/or current control may be provided by a operational amplifier 302 which may be capable of detecting lamp current, through, for example, feedback circuit 16, and comparing the lamp current to a threshold signal ADJ. Operational amplifier 302 may be capable of providing steady state lamp current regulation. ADJ may be a signal proportional to panel brightness setting signal, and may be selected based on, for example, operational amplifier 302 optimized input voltage range. If the lamp current exceeds or is less than ADJ, the output of operational amplifier 302 may cause the inverter controller 12' to adjust power to the lamp, i.e., until the lamp current and ADJ are approximately equal.

Also, in this embodiment, a comparator 304 may be provided to detect a lamp on condition (where "lamp on" means a lamp has ignited). Conventional inverter controllers identify whether a lamp is turned on by detecting if the lamp current reaches a threshold, and the threshold for lamp on detection is typically much less than the threshold for steady state lamp current regulation. If the conventional inverter controller detects lamp current during a striking period, because the lamp on threshold is comparatively small, the conventional inverter controller may cease ignition mode and switch to steady state operation. However, if the lamp is not properly struck, steady state current is insufficient to properly ignite the lamp, and the lamp may fail to ignite.

Thus, in the present embodiment of FIG. 3, comparator 304 may compare the striking current (ignition power), as may be provided to a lamp during an ignition period, to a signal that is approximately equal to a signal indicative of steady state power supplied to the lamp, for example, ADJ. As used herein, the term "approximately" may mean within a given tolerance level and/or within a value that may prevent the inverter controller 12' from prematurely ending an ignition period of a lamp. Thus, for example, by setting the lamp on detection threshold signal for comparator 304 approximately equal to the steady state power threshold signal for operational amplifier 302, the inverter controller 12 of the present embodiment may be capable of differentiating the relatively small voltage and/or current that the lamp may exhibit during the striking period and the transition period (206 and 210, respectively, in FIG. 2) from the larger current and/or voltage the lamp may exhibit during a steady state period (208 in FIG. 2). Also, by comparing the striking current (ignition power) provided to a lamp during an ignition period to a signal that is approximately equal to a signal indicative of steady state power, inverter controller 12' may be capable of maintaining the supply of ignition power to the lamp while the feedback signal remains below the signal indicative of steady state power.

Figure 4:
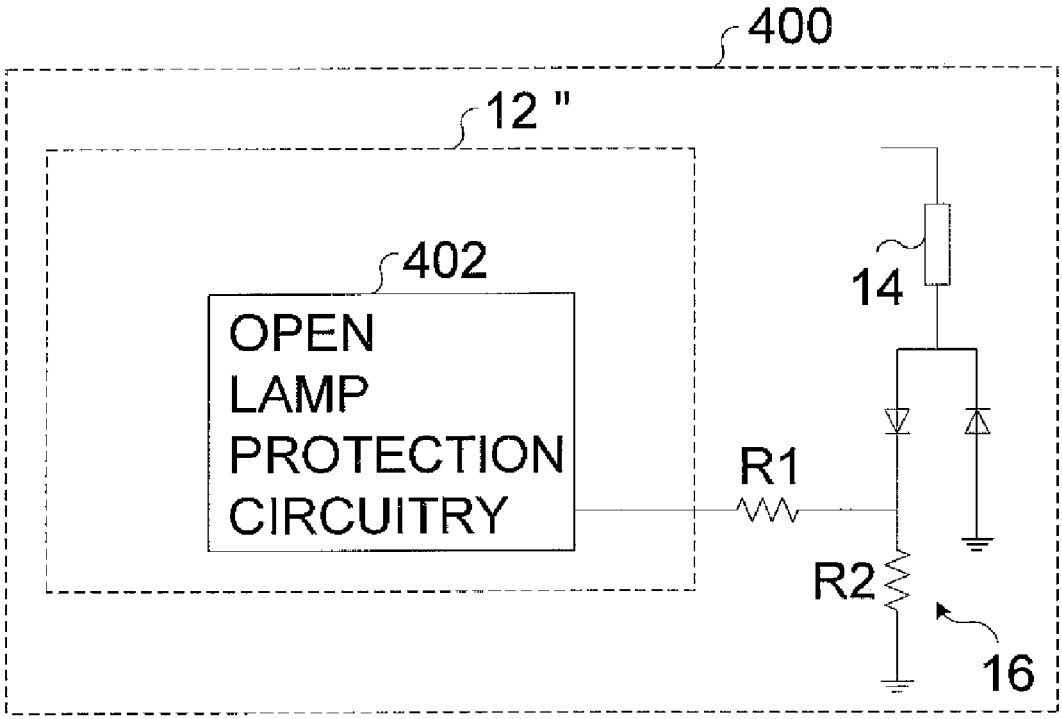
FIG. 4 is a diagram illustrating another exemplary inverter controller.

FIG. 4 depicts an inverter controller 12" according to another embodiment. In this embodiment, inverter controller 12" may include open lamp timer circuitry 402. Open lamp timer circuitry 402 may operate during a lamp ignition period, and may cause output circuitry to control the switches to generate a minimal pulse width and gradually increase the pulse width until the lamp is ignited. In a conventional inverter controller, the delay time is typically less than 1 ms after lamp current is detected.

In the present embodiment, open lamp protection circuitry 402 may be capable of extending the delay time between, for example, the time that inverter controller 12" is initially enabled and the end of an open lamp protection period to provide sufficient time for the lamp to ignite. In this embodiment, open lamp protection circuitry 402 may be capable of causing the inverter control 12" to terminate the supply of ignition power, and open lamp protection circuitry 402 may be capable of delaying causing inverter controller 12" to terminate the supply of ignition power until the lamp is struck.

Figure 5:
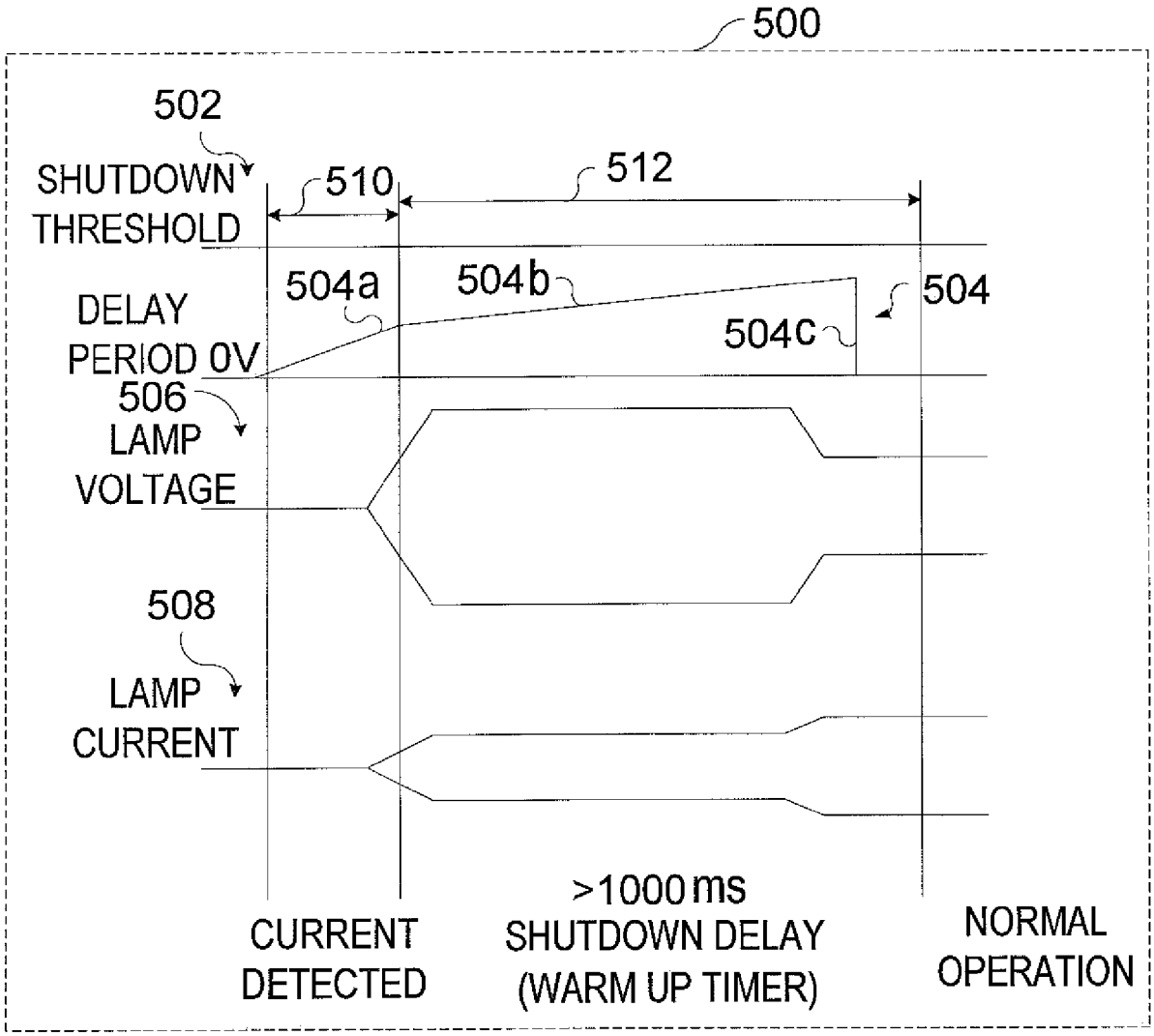
FIG. 5 is a graph depicting an exemplary delay period according to one embodiment.

FIG. 5 depicts a graph 500 of exemplary delay period for open lamp circuitry 402. The graph 500 depicts a delay signal 504 generated by open lamp timer circuitry 402 in relation to the lamp voltage 506 and lamp current 508. A shutdown threshold signal 502 is also depicted, and in this embodiment, if signal 504 equals or exceeds signal 502, open lamp timer circuitry 402 may cause inverter controller 12" to cease ignition mode. After the inverter controller is initially enabled a period of time may pass 510 until open lamp timer circuitry detects lamp current. During period 510, the slope of the signal 504 generated by open lamp timer circuitry 402 may increase linearly with a first slope 504*a*. Once current and/or voltage is detected by open lamp timer circuitry 402, open lamp timer circuitry 402 may decrease the slope of signal 504 to a second slope 504*b*, which may extend the time before signal 504 equals or exceeds signal 502. In this embodiment, the delay period 512 of open lamp protection circuitry 402 may be set so that the inverter controller is permitted to operate into the ignition period, for example, for approximately 100 to 1000 ms or more after lamp current and/or voltage is initially detected. Once lamp voltage 506 and/or lamp current 508 assume a steady state value, open lamp timer circuitry 402 may terminate signal 504 (as shown by 504*c*). Alternatively or additionally, in this embodiment, the lamp voltage may be compared to a shutdown threshold 502, and if the lamp voltage exceeds this threshold the inverter controller may terminate ignition of the lamp.

Thus, in summary, at least one embodiment described herein may comprise an inverter controller capable of supplying ignition power and steady state power to at least one lamp. The inverter controller of this embodiment may also be capable of receiving, during an ignition period of the lamp, a feedback signal indicative of power supplied to said lamp and comparing, via a comparator, the feedback signal to a signal that is approximately equal to a signal indicative of steady state power and maintaining a supply of ignition power to the lamp while the feedback signal remains below the signal indicative of steady state power.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. An apparatus, comprising:

an inverter controller configured to supply ignition power and steady state power to at least one lamp, wherein said inverter controller is also configured to receive, during an ignition period of said lamp, a feedback signal indicative of power supplied to said lamp and comparing, via a comparator, said feedback signal to a predetermined signal approximately indicative of said steady state power and maintaining a supply of said ignition power to said lamp while said feedback signal remains below said predetermined signal, wherein said steady state power is proportional to a panel brightness setting signal.

2. The apparatus of claim 1, wherein: said lamp comprises a cold cathode fluorescent lamp (CCFL).

3. The apparatus of claim 1, wherein: said inverter controller comprises a topology selected from the group consisting of: a full bridge, half bridge, a push-pull and a Class D inverter topology.

4. The apparatus of claim 1, wherein:

said inverter controller further comprising open lamp protection circuitry configured to cause said inverter control to terminate said supply of said ignition power, said open lamp protection circuitry configured to delay causing said inverter control to terminate said supply of said ignition power for at least 1 millisecond.

5. A system, comprising:

a liquid crystal display (LCD) panel comprising at least one lamp; and an inverter controller configured to supply ignition power and steady state power to said at least one lamp, wherein said inverter controller is also configured to receive, during an ignition period of said lamp, a feedback signal indicative of power supplied to said lamp and comparing, via a comparator, said feedback signal to a predetermined signal approximately indicative of said steady state power and maintaining a supply of said ignition power to said lamp while said feedback signal remains below said predetermined signal, wherein said steady state power is proportional to a panel brightness setting signal.

6. The system of claim 5, wherein: at least one said lamp comprises a cold cathode fluorescent lamp (CCFL).

7. The system of claim 5, wherein: said inverter controller comprises a topology selected from the group consisting of: a full bridge, half bridge, a push-pull and a Class D inverter topology.

8. The system of claim 5, wherein:

said inverter controller further comprising open lamp protection circuitry configured to cause said inverter control to terminate said supply of said ignition power, said open lamp protection circuitry configured to delay causing said inverter control to terminate said supply of said ignition power for at least 1 millisecond.

9. A method, comprising:

supplying ignition power to at least one lamp;

receiving, during an ignition period of said lamp, a feedback signal indicative of power supplied to said lamp;

comparing said feedback signal to a predetermined signal approximately indicative of steady state power; and maintaining a supply of said ignition power to said lamp while said feedback signal remains below said predetermined signal indicative of said steady state power, wherein said steady state power is proportional to a panel brightness setting signal.

10. The method of claim 9, further comprising:

delaying causing said inverter control to terminate said supply of ignition power for at least 1 millisecond.

* * * * *